United States Patent [19]

Tripp et al.

[11] 3,986,409

[45] Oct. 19, 1976

[54] PUSH-TO-ENGAGE DEVICE

[75] Inventors: William V. Tripp, Watertown; Robert H. Broadbent, Pembroke, both of Mass.

[73] Assignee: Raytheon Company, Lexington, Mass.

[22] Filed: July 7, 1975

[21] Appl. No.: 593,612

[52] U.S. Cl. ..... 74/548; 74/553; 74/554; 188/83; 192/34; 192/95; 192/108

[51] Int. Cl.[2] ..... G05G 1/02

[58] Field of Search ..... 74/553, 504, 548, 3; 188/83; 192/95

[56] References Cited

UNITED STATES PATENTS

| | | | |
|---|---|---|---|
| 2,797,592 | 7/1957 | Marrapese | 74/553 X |
| 2,917,942 | 12/1959 | Jarrett et al. | 74/504 |
| 3,025,931 | 3/1962 | Jones | 188/83 |
| 3,144,919 | 8/1964 | Foote et al. | 188/83 X |
| 3,319,484 | 5/1967 | Prest | 188/83 X |

*Primary Examiner*—Samuel Scott
*Assistant Examiner*—F. D. Shoemaker
*Attorney, Agent, or Firm*—John T. Meaney; Joseph D. Pannone; Harold A. Murphy

[57] ABSTRACT

A push-to-engage device comprising a hollow knob having axially disposed therein an independent bushing provided with a fastener for bindingly engaging an inserted end portion of a rotatable shaft and with a plurality of recesses disposed for engagement with keys protruding inwardly from the knob, and an external resilient device coupled to the knob for positioning the keys in spaced relationship with the recesses in the bushing.

8 Claims, 4 Drawing Figures

PUSH-TO-ENGAGE DEVICE

BACKGROUND OF THE INVENTION

This invention relates generally to control knobs and is concerned more particularly with a knob having means for preventing accidental rotation of a critical adjustment shaft.

The operation of equipment today is controlled, to a great extent, by rotationally adjustable devices, such as valves, timers, rheostats, potentiometers, rotary capacitors, gang switches and the like. Such devices generally comprise a body having protruding therefrom a threaded collar through which extends a rotatable adjustment shaft. Thus, a device of the described type may be mounted on the rear surface of a control panel having an aligned hole through which the threaded collar and rotatable shaft protrude. Accordingly, on the front surface of the panel, the threaded collar may be engaged by a suitable fastener, such as a hex nut, for example, to secure the device to the rear surface of the panel; and the distal end portion of the shaft may have affixed thereto a suitable control knob.

However, a critically adjusted control device of the described type generally is mounted in a more remote portion of the equipment, such as in the rear of a console, for example. Thus, the critical device may be reached for adjustment by a skilled technician only after opening a rear door of the console or removing a safety interlocked cover of the equipment, for examples. Also, in order to avoid variation of the adjustment due to shock or vibration, the device may be provided with a locking means for holding the rotatable shaft in an adjusted position. Further, such critically adjusted devices generally require an accessory tool such as a screw driver, for example, in order to effect the desired adjustment. Consequently, the critically adjusted control device is not readily accessible to a skilled technician for timely adjustment, when required.

Therefore, it would be advantageous and desirable to provide a control device with a knob having means for preventing accidental adjustment thereof and which, consequently, may be mounted on the readily accessible control panel.

SUMMARY OF THE INVENTION

Accordingly, this invention provides a push-to-engage device comprising a hollow body having axially disposed therein an independent coupler provided with fastening means for bindingly engaging an inserted end portion for a rotatable shaft. The body has an inner surface supporting a protrusion which is suitably spaced from recess means in the coupler by an external resilient means. Thus, when the coupler is mounted on the inserted end portion of the rotatable shaft, the body may be rotated without engaging the recess means in the coupler. However, when the body is pressed with sufficient force to overcome the pressure exerted by the resilient means, the protrusion engages the recess means in the coupler. As a result, rotation of the knob produces a corresponding rotation of the coupler and the bindingly engaged shaft.

A preferred embodiment of this invention comprises a cup-shaped housing having a closed end, the inner surface of which supports a longitudinally extending blade-like protrusion. The adjacent end surface of the axially disposed bushing is provided with a circular array of diametric-intersecting slots, each being of sufficient width and depth to accept the blade-like protrusion. The bushing is retained within the cup-shaped housing by a coaxially disposed washer which is press-fitted into the open end of the housing. The external surface of the retaining washer may have affixed thereto one end of an axially disposed spring, which comprises the resilient means for positioning the blade-like protrusion in spaced relationship with the slots in the bushing. Alternatively, the spring may be independent of the washer and slid onto the rotatable shaft before the distal end portion of the shaft is inserted through the retaining washer and into the bushing. The bushing may have extending radially through the walls thereof one or more set screws which may be journaled into binding engagement with the shaft by a tool inserted through an access aperture in the knob.

BRIEF DESCRIPTION OF THE DRAWINGS

For a better understanding of this invention, reference is made in the following more detailed description to the accompanying drawings wherein.

DESCRIPTION OF THE PREFERRED EMBODIMENT

Figure 1:
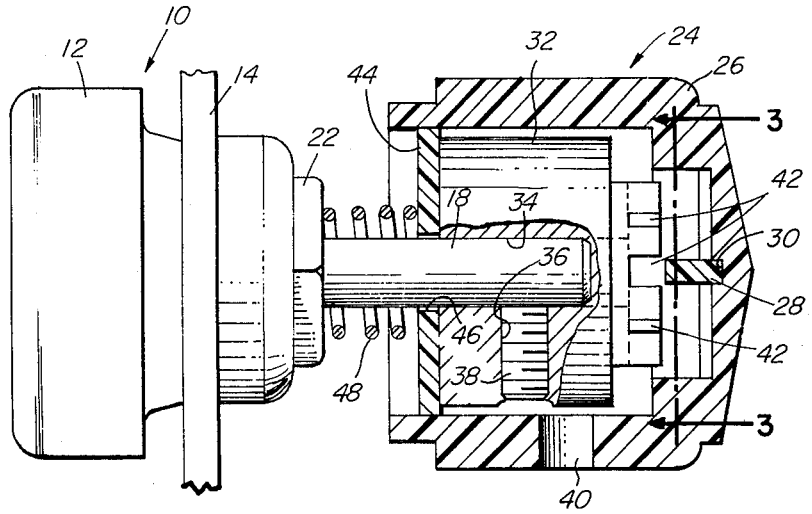
FIG. 1 is an enlarged elevational view, partly in section, showing a control device provided with the knob assembly of this invention in the unengaged position.
Figure 3:
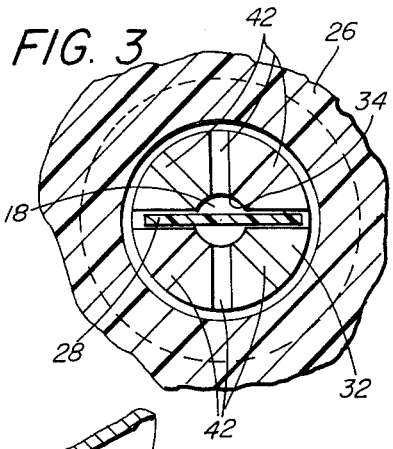
FIG. 3 is a cross-sectional view taken along line 3—3 in FIG. 1 looking in the direction of the arrows.

Referring to the drawing wherein like characters of reference designate like parts throughout the several views. There is shown in FIGS. 1–4 a control device 10, such as a potentiometer, for example, having a cylindrical body 12 supported on the rear surface of a control panel 14. Protruding axially from the body 12 is an externally threaded collar 16 through which extends a rotatable shaft 18. The collar 16 and shaft 18 are inserted through an aligned hole 20 in panel 14 and the collar 16 is threadingly engaged by a suitable fastener 22 which secures the panel 14. The fastener 22 preferably comprises a shaft-lock type of fastener disclosed in U.S. Pat. No. 2,854,099, the same being granted to Neil F. Damon and assigned to the assignee of this invention. The referenced shaft-lock fastener supplies shaft 18 with a control wiping drag which is sufficiently tight to hold the shaft stationary under conditions of shock and vibration but not so tight as to prohibit rotational adjustment of the shaft.

The distal end portion of shaft 18 is engaged by a control knob assembly 24 including a cup-shaped housing 26 made of suitable material, such as polycarbonate resin, for example. The closed end of housing 26 supports an inwardly protruding key 28 made of rigid material, such as stainless steel, for example. Key 28 may have a blade-like configuration and be bonded by suitable means, such as epoxy resin, for example, edgewise into a slot 30 which is transversely disposed in the closed end of housing 26. Alternatively, the key 28 may have any desired rotary interlocking configuration, such as an axially extending hex-shaped rod having an end portion suitably bonded to the closed end of housing 26, for example. As a further alternative, the key 28 may be molded as an integral part of housing 26.

Figure 2:
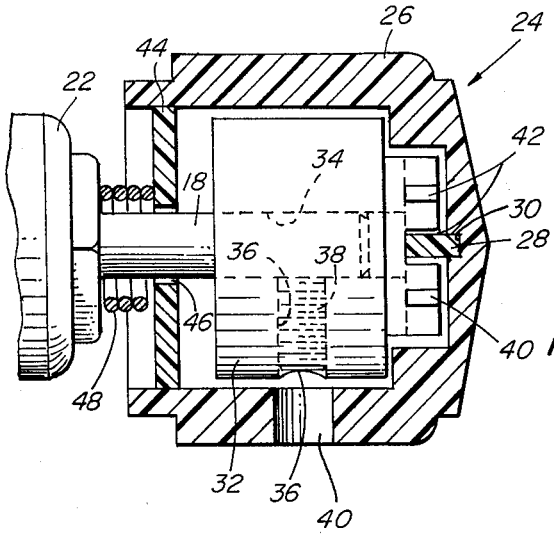
FIG. 2 is an enlarged elevational view, partly in section, showing the knob assembly of this invention in the engaged position.
Figure 4:
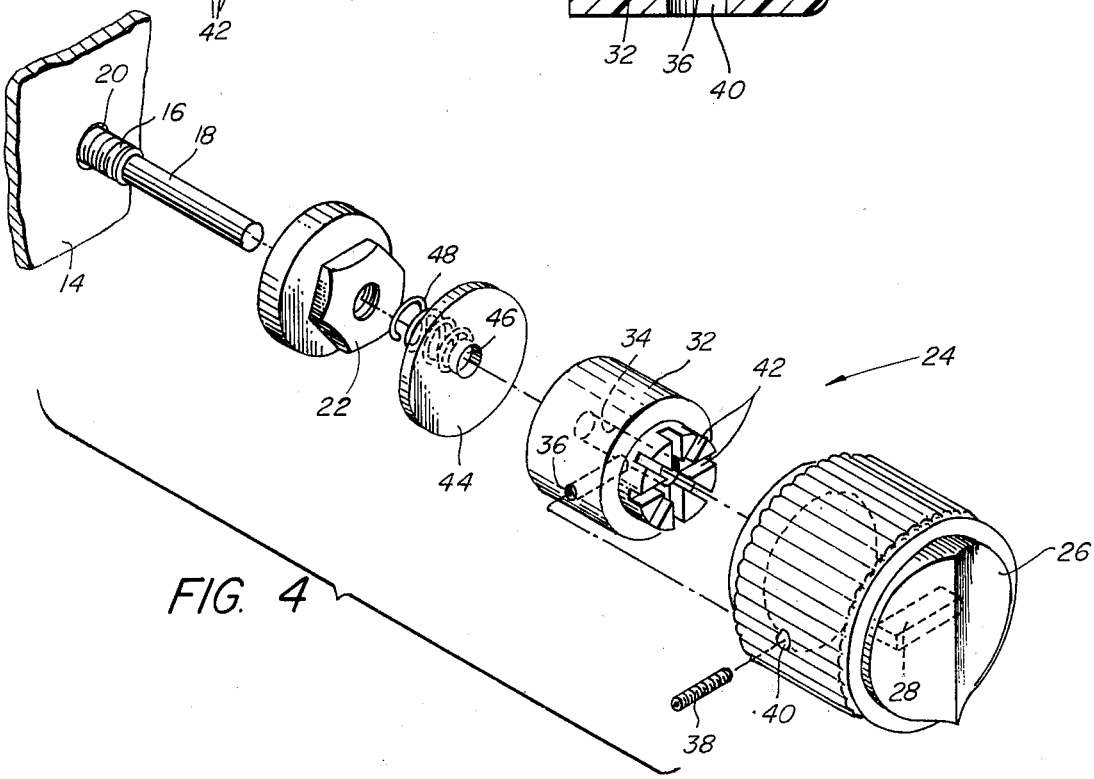
FIG. 4 is an exploded view of the knob assembly shown in FIGS. 1 and 2.

Axially disposed in housing 26 is a coupling means comprising an independent bushing 32 made of suitable material, such as aluminum for example. The bushing 32 has a central axial bore 34 wherein the distal end portion of shaft 18 is slidably inserted. Extending radially through the cylindrical wall of bushing 32 is an internally threaded aperture 36 having journaled therein a set screw 38. An access aperture 40 is provided in the longitudinal wall of housing 26 which, as shown in FIG. 2, provides means for inserting a tool to journal set screw 38 into binding engagement with the shaft 18. Although only one set screw 38 is shown, it is to be understood that any number of angularly spaced set screws may be provided, as described, in bushing 32 for bindingly engaging the shaft 18.

The end surface of bushing 32 adjacent the closed end of housing 26 is provided with recess means for pressure engagement with the key 28. Thus, as shown clearly in FIG. 3, the recess means may comprise a circular array of diametric intersecting slots 42, each having sufficient width and depth to receive therein the blade-like key 28. Alternatively, if the key 28 constitutes the previously noted, hex-shaped shaft, the associated recess means may comprise a hex-shaped socket centrally disposed in the adjacent end surface of bushing 32, for example. Accordingly, the recess means may comprise any number of cavities, each having a suitable configuration for rotary interlocking engagement with a conformingly shaped key 28 protruding from the inner surface of housing 26.

A retaining washer 44 made of suitable elastic material such as polyamide, for example, is press fitted into the open end of housing 26. The washer 44 is provided with a central aperature 46 which is substantially aligned with the central bore 34 in bushing 32. Thus, the washer 44 retains the bushing 32 within housing 26 when the control knob assembly is not mounted on the shaft 18. Also, the aperture 46 in washer 44 provides means for permitting the distal end portion of shaft 18 to enter the housing 26 and slidably engage the bushing 32.

Axially aligned with aperture 46 in washer 44 is a coil spring 48 having one end bearing against the exterior surface of washer 44 and an opposing end bearing against the shaft lock fastener 22. The end of spring 46 adjacent the washer 44 may be fixedly secured to the exterior surface thereof, or the spring 46 may be independent of the washer 44. In either instance, the spring 46 constitutes a resilient means external of the housing 26 for bearing against the washer 44 to resiliently position the key 28 in spatial relationship with the slots 42 in bushing 32, as shown in FIG. 1. However, as shown in FIG. 2, when the housing 26 is pressed axially, the key 28 engages one of the slots 42 in bushing 32 and, consequently, rotation of the housing 26 produces corresponding rotation of the bushing 32 and the bindingly engaged shaft 18.

In this manner, the shaft 18 is rotatably engaged only by applying sufficient axial force to the housing 26 to overcome the pressure exerted by spring 46 against washer 44. Then, the control device 10 may be adjusted by applying a torque to housing 26 sufficient to overcome the frictional drag exerted on shaft 18 by the shaft lock fastener 22. Accordingly, when the housing 26 is released, the key 28 is withdrawn from slot 42 by resilient pressure of coil spring 46 against washer 44. As a result, subsequent idle or accidental rotation of the housing 26 does not cause rotation of the shaft 18 to upset the adjustment of control device 10. Furthermore, the coil spring 46 is advantageously located externally of the housing 26, where it cannot interfere with relatively movable parts, such as the walls of housing 26 and the adjacent walls of independent bushing 32, for example. Also, by locating the spring 46 externally of housing 26, it cannot interfere with the key 28 engaging the recess means in bushing 32, when desired.

From the foregoing, it will be apparent that all of the objectives of this invention have been achieved by the structures shown and described. It also will be apparent, however, that various changes may be made by those skilled in the art without departing from the spirit of the invention as expressed in the appended claims. It is to be understood, therefore, that all matter shown and described herein is to be interpreted as illustrative and not in a limiting sense.

What is claimed is:

1. A control knob assembly for rotatably engaging an adjustment shaft and comprising:

a hollow body including a cup-shaped housing and a retaining washer fitted into the open end thereof, the washer having centrally disposed aperture means for permitting insertion of the shaft axially into the housing and the housing having first interlocking means for rotating the shaft;

an independent coupler device disposed within the body, the coupler having fastening means for bindingly engaging the shaft and second interlocking means for releasable engagement with the first interlocking means; and resilient means external of the body and coupled thereto for resiliently positioning the first interlocking means in spaced relationship with the second interlocking means.

2. A control knob assembly as set forth in claim 1 wherein the coupler device comprises a bushing axially disposed within the cup-shaped housing and having an axial bore into which the shaft is inserted.

3. A control knob assembly as set forth in claim 2 wherein the first interlocking means comprises a key fixedly attached to the closed end of the housing, and the second interlocking means comprises conformingly-shaped recess means disposed in the adjacent surface of the bushing for pressure engagement with the key.

4. A control knob assembly as set forth in claim 3 wherein the resilient means comprises a coil spring axially aligned with the aperature means of the washer and having one end coupled to the exterior surface of the washer.

5. In combination:

a rotatable shaft having a distal end portion;

rotation resisting means coupled to the shaft for applying a frictional drag thereto;

knob means mounted on the distal end portion of the shaft, the knob means including coupling means for rotatably engaging the shaft in a releasable manner and including a hollow body having therein a protrusion fixedly attached to the body; and resilient means mounted on an intermediate portion of the shaft between the rotation resisting means and the knob means for maintaining the knob means in a released condition with respect to the shaft.

6. The combination as set forth in claim 5 wherein the coupling means includes a coupler device independent of the body and disposed therein, the device having fastening means for bindingly securing the device to the shaft and having interlocking means disposed adjacent the protrusion for pressure engagement therewith.

7. The combination as set forth in claim 6 wherein the resilient means includes a coil spring disposed axially in encircling relationship with said intermediate portion of the shaft.

8. The combination as set forth in claim 5 wherein one end of the coil spring is coupled directly to the body.

* * * * *